United States Patent [19]

Mariaux et al.

[11] Patent Number: 4,459,725

[45] Date of Patent: Jul. 17, 1984

[54] METHOD FOR ATTACHING A BALLISTIC HOOD AT A PROJECTILE BODY

[75] Inventors: Jacques Mariaux, Herrliberg; Rudolf Rossman, Zürich, both of Switzerland

[73] Assignee: Werkzeugmaschinenfabrik Oerlikon-Bührle AG, Zürich, Switzerland

[21] Appl. No.: 400,661

[22] Filed: Jul. 22, 1982

[30] Foreign Application Priority Data

Aug. 5, 1981 [CH] Switzerland ..... 5043/81

[51] Int. Cl.[3] ..... B21K 21/06; B23D 19/02; B23D 11/02

[52] U.S. Cl. ..... 29/1.2; 29/235; 29/451

[58] Field of Search ..... 29/1.2, 235, 236, 451; 102/517, 518, 519, 513, 520, 521, 522, 523

[56] References Cited

U.S. PATENT DOCUMENTS

| | | | |
|---|---|---|---|
| 3,507,221 | 4/1970 | Grolly | 102/523 |
| 3,780,658 | 12/1973 | de Longueville | 102/518 |
| 3,890,902 | 6/1975 | Travor | 102/518 |
| 4,249,466 | 2/1981 | Rossman et al. | 102/521 |
| 4,305,772 | 12/1981 | Valyi | 29/235 |

FOREIGN PATENT DOCUMENTS

| | | |
|---|---|---|
| 416452 | 7/1936 | Belgium . |
| 1348590 | 11/1962 | France . |
| 622883 | 12/1978 | Switzerland . |

*Primary Examiner*—Howard N. Goldberg
*Assistant Examiner*—Steven Nichols
*Attorney, Agent, or Firm*—Werner W. Kleeman

[57] ABSTRACT

For the attachment of a ballistic hood at a projectile body prior art constructions of projectiles provided a groove in the projectile body. The employment of such groove in the projectile body is undesired for armor-piercing projectiles. By adhesively bonding the ballistic hood to the projectile body there can be avoided the use of such groove. Through the provision of ribs at the inner surface of the ballistic hood which contacts the projectile body there is afforded an exact alignment and centering of the ballistic hood upon the projectile body.

7 Claims, 2 Drawing Figures

METHOD FOR ATTACHING A BALLISTIC HOOD AT A PROJECTILE BODY

BACKGROUND OF THE INVENTION

The present invention relates to a new and improved method of attaching a ballistic hood at a projectile body which possesses a substantially smooth conical surface for the reception and mounting of the ballistic hood thereat.

According to a known projectile of this type, as disclosed, for instance, in U.S. Pat. No. 4,249,466 granted Feb. 10, 1981 and the cognate Swiss Pat. No. 622,883, granted Apr. 30, 1981, there is provided for the purpose of attaching the hood at the projectile body a substantially ring-shaped groove in the projectile body. A likewise substantially ring-shaped rib member provided at the ballistic hood or hood member protrudes into this ring-shaped groove. Because of its notch effect the use of such groove at the circumference of the projectile body is undesired for armor-piercing projectile.

SUMMARY OF THE INVENTION

Therefore, with the foregoing in mind it is a primary object of the present invention to provide a new and improved method for the attachment of a ballistic hood at a projectile body in a manner not associated with the aforementioned drawbacks and limitations of the prior art proposals.

Another and more specific object of the present invention aims at providing a novel attachment for securing a hood to a projectile body, by means of which there can be avoided the use of a groove which is disadvantageous for the armor-piercing of the projectile.

Still a further significant object of the present invention is directed to a novel method of securing a ballistic hood member to a projectile body in an extremely reliable and efficient manner, affording a positive attachment of the ballistic hood at the projectile body.

Now in order to implement these and still further objects of the invention, which will become more readily apparent as the description proceeds, the method of the present development is manifested by the steps of:

(a) providing the ballistic hood at its inner surface intended to come into contact with the projectile body with substantially ring-shaped deformable ribs and an adhesive material;

(b) centering the projectile body in a clamping or collet chuck;

(c) centering the hood in a pressure or press-on chuck; and (d) pressing the inner surface of the ballistic hood provided with the ring-shaped deformable ribs and with the adhesive material upon the substantially conical-shaped smooth surface of the projectile body with the aid of a contact or pressing punch.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
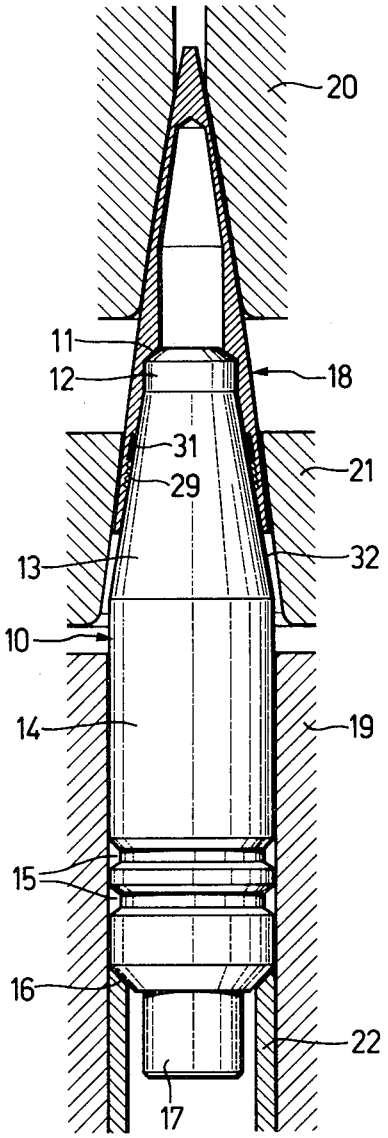
FIG. 1 is a side view, partially in section, of a projectile body equipped with a ballistic hood and illustrating the attachment tools used in securing the ballistic hood to the projectile body.

Describing now the drawings, in FIG. 1 there has been depicted the projectile body 10 which is provided at its front end with a substantially conical hood support portion 11. Behind this hood support portion 11 there is located a substantially cylindrical hood centering portion 12 and a substantially conical portion 13 at which merges a substantially cylindrical portion 14. At the tail of the projectile body 10 there are provided two circumferential grooves 15 which serve for anchoring the projectile body 10 at a not particularly illustrated but conventional sabot. Anchored at the conical rear end surface 16 of the projectile body 10 is a sleeve member 17 for a luminescent or flare charge In a manner to be described more fully hereinafter and in accordance with the method aspects of the invention a ballistic hood or hood member 18 of the type which will be described more fully hereinafter in conjunction with FIG. 2, is secured to such projectile body 10.

Continuing, and again reverting to FIG. 1 the projectile body 10 is located in a suitable clamping device, such as the clamping or collet chuck 19, and the ballistic hood or hood member 18 protrudes into a suitable attachment device, here a pressure or press-on chuck 20. For pressing the ballistic hood 18 against the projectile body 10 there is provided a suitable pressure exerting tool, here shown as a contact or pressing punch 21. The projectile body 10 located in the chuck 19 or equivalent structure is supported exclusively upon a support sleeve member 22.

Figure 2:
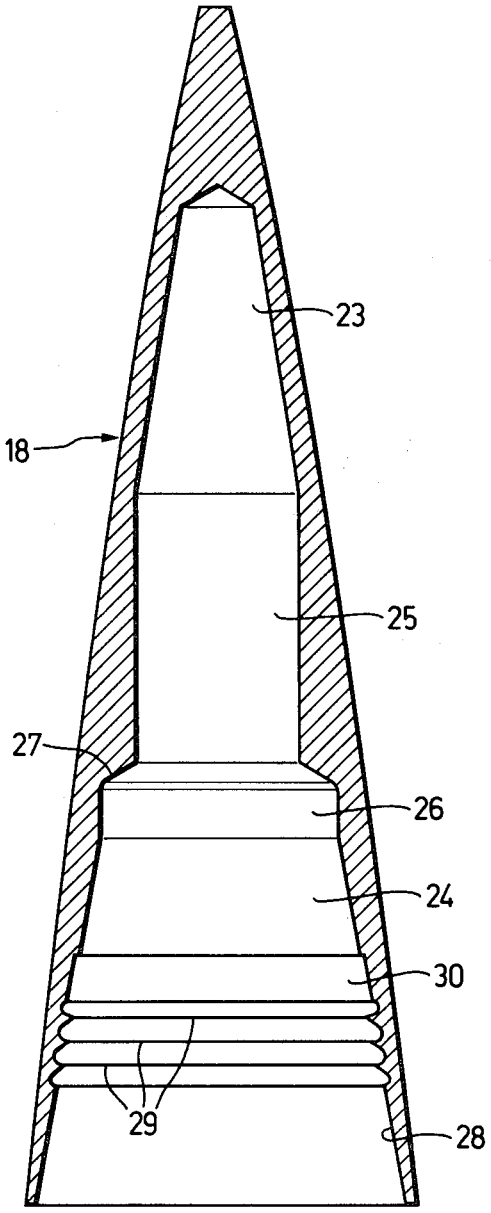
FIG. 2 is an enlarged cross sectional view of the ballistic hood or hood member shown in the arrangement of FIG. 1.

Turning attention now to FIG. 2, the ogive-shaped ballistic hood 18 will be seen to contain a hollow compartment or space which is constituted by three portions or sections 23, 24 and 25 and specifically, by a forward substantially conical portion or section 23, a rear substantially conical portion or section 24, and an intermediate substantially cylindrical portion or section 25. The rear conical portion 24 opens into a substantially cylindrical portion 26. Between the intermediate portion 25 and the cylindrical portion 26 of the rear conical portion 24 there is provided a substantially conical support surface 27 which is intended to bear upon and come into contact with the conical hood support portion 11. The inner surface 28 of the rear conical portion 24 possesses a number of relatively easily deformable ribs or rib members 29 or equivalent protuberances. Arranged forwardly of such ribs 29 is a recess 30 for receiving a suitable adhesive material 31, which has been specifically shown in FIG. 1. The ribs 29 tend to appreciably improve the effect of the adhesive material 31.

In order to attach the ballistic hood 18 at the projectile body 10 initially the projectile body 10 is inserted into the clamping chuck 19 until it bears upon the support sleeve member 22. Furthermore, the ballistic hood 18, after it has been provided with the adhesive or adhesive material 31 in the recess 30, is inserted into the pressure or press-on chuck 20 and pressed on to the projectile body 10. Finally, with the aid of the pressure punch 21 the inner surface 28 of the ballistic hood 18 is pressed against the smooth surface 32 of the conical portion or section 13 provided at the projectile body 10.

Consequently, the ribs or rib members 29 are deformed and thus render possible an exact centering of the ballistic hood 18, and there is prevented that the hood 18 will be seated at an inclination or obliquely upon the projectile body 10.

By virtue of the described method for the attachment of the ballistic hood 18 at the projectile body 10 it is no longer necessary to arrange at the projectile body 10 attachment grooves or the like for securing the ballistic hood 18 at the projectile body 10. Due to the provision of the conical support surface 27 at the ballistic hood 18, which is seated upon the conical hood support portion or hood support 11 and by virtue of the provision of the ribs 29 which bear upon the smooth surface of the conical portion 13 provided at the projectile body 10, there is afforded a reliable centering of the hood member 18 upon the projectile body 10. Additionally, the cylindrical portion 26 of the ballistic hood 18 is inserted with a press fit upon the cylindrical hood centering portion 12. Moreover, the use of the adhesive material 31 insures for a reliable and positive connection of the ballistic hood 18 at the projectile body 10.

While there are shown and described present preferred embodiments of the invention, it is to be distinctly understood that the invention is not limited thereto, but may be otherwise variously embodied and practiced within the scope of the following claims. Accordingly,

What we claim is:

1. A method for the attachment of a ballistic hood at a projectile body possessing a substantially conical smooth surface for receiving the hood, comprising the steps of:

providing the ballistic hood at an inner surface thereof intended to contact the conical smooth surface of the projectile body with substantially ring-shaped deformable ribs and an adhesive material;

centering the projectile body in a first centering tool;

centering the ballistic hood in a second centering tool; and pressing the inner surface of the ballistic hood provided with the ring-shaped deformable ribs and the adhesive material by means of a pressing tool onto the substantially conical smooth surface of the projectile body.

2. The method as defined in claim 1, further including the steps of:

using as the first centering tool for the projectile body a clamping chuck;

using as the second centering tool for the ballistic hood a pressure chuck; and using as the pressing tool a contact punch.

3. The method as defined in claim 1, further including the step of:

providing said recess forwardly of said deformable ribs at the inner surface of said ballistic hood.

4. A method for the attachment of a ballistic hood at a projectile body possessing a substantially conical smooth surface for receiving the hood, comprising the steps of:

providing the ballistic hood at an inner surface thereof intended to contact the conical smooth surface of the projectile body with substantially ring-shaped deformable ribs;

providing the ballistic hood at the inner surface thereof intended to contact the conical smooth surface of the projectile body with a substantially ring-shaped recess and filling said recess with an adhesive material;

centering the projectile body in a first centering tool;

centering the ballistic hood in a second centering tool; and pressing the inner surface of the ballistic hood provided with the ring-shaped deformable ribs and the ring-shaped recess filled with the adhesive material by means of a pressing tool onto the substantially conical smooth surface of the projectile body.

5. The method as defined in claim 4, further including the steps of:

providing a substantially cylindrical portion forwardly of the conical smooth surface at the projectile body;

providing a substantially cylindrical portion forwardly of said recess at said ballistic hood; and press-fitting said substantially cylindrical portion of said ballistic hood to said substantially cylindrical portion of said projectile body while pressing said inner surface of said ballistic hood to said conical smooth surface on said projectile body.

6. The method as defined in claim 4, further including the steps of:

providing a substantially conical hood support portion forwardly of said substantially cylindrical portion at the projectile body;

providing a substantially conical support surface forwardly of said substantially cylindrical portion at the ballistic hood; and seating said substantially conical support surface of said ballistic hood at said substantially conical hood support portion of said projectile body while pressing said inner surface of the ballistic hood to said conical smooth surface on said projectile body, in order to assist in the centering of the ballistic hood relative to the projectile body.

7. The method as defined in claim 4, further including the steps of:

providing substantially ring-shaped grooves between said ring-shaped deformable ribs; and filling said ring-shaped grooves with an adhesive material.

* * * * *